US011746531B1

(12) United States Patent
Polston

(10) Patent No.: US 11,746,531 B1
(45) Date of Patent: Sep. 5, 2023

(54) ROOF EDGE INTAKE VENT

(71) Applicant: Ross Manufacturing, LLC., New Braunfels, TX (US)

(72) Inventor: Scott Ross Polston, New Braunfels, TX (US)

(73) Assignee: Ross Manufacturing, LLC, New Braunfels, TX (US)

( * ) Notice: Subject to any disclaimer, the term of this patent is extended or adjusted under 35 U.S.C. 154(b) by 0 days.

(21) Appl. No.: 17/476,869

(22) Filed: Sep. 16, 2021

(51) Int. Cl.
*E04D 13/17* (2006.01)

(52) U.S. Cl.
CPC ..... *E04D 13/178* (2013.01)

(58) Field of Classification Search
CPC ..... E04D 13/178
See application file for complete search history.

(56) References Cited

U.S. PATENT DOCUMENTS

| | | | | |
|---|---|---|---|---|
| 5,630,752 | A | 5/1997 | Gubash | |
| 5,832,677 | A | 11/1998 | Kurttila | |
| 6,129,628 | A | 10/2000 | O'Hagin et al. | |
| 6,212,833 | B1 | 4/2001 | Henderson | |
| 6,447,392 | B1 | 9/2002 | Henderson | |
| 7,044,852 | B2 | 5/2006 | Horton | |
| D574,947 | S | 8/2008 | Grisham et al. | |
| D602,579 | S * | 10/2009 | Stone | D23/373 |
| 8,292,707 | B2 * | 10/2012 | Grisham | E04D 13/17 454/260 |
| D710,985 | S | 8/2014 | Gassman et al. | |
| D729,927 | S | 5/2015 | Fiser | |
| 9,022,845 | B2 | 5/2015 | Henderson | |
| 10,370,855 | B2 * | 8/2019 | Gassman | E04D 13/178 |
| RE47,799 | E | 1/2020 | Henderson | |

FOREIGN PATENT DOCUMENTS

| | | | | |
|---|---|---|---|---|
| GB | 2281389 A * | 3/1995 | | E04D 13/178 |
| GB | 2335666 | 9/1999 | | |

OTHER PUBLICATIONS

Author: Unknown; www.airvent.com/index.php/products/intake-vents/the-edge-vent, Date: unknown.
Author: Unknown; www.lomanco.com/vents/intake-vents, Date; Unknown.
Author:Unknown; www.gaf.com/en-us/roofing-prducts/residential-roofing-products/ventilation-and-attic-vents/intake/intake-rooftop-intake-vents/cobra-intake-pro.
Author: Unknown; www.owenscorning.com/en-us/roofing/products/inflow-vent.

* cited by examiner

*Primary Examiner* — Adriana Figueroa
(74) *Attorney, Agent, or Firm* — Eric Karich; Karich & Associates

(57) ABSTRACT

A roof edge intake vent has a base sheet member that rests over a roof opening and includes an upper edge having an upper mounting structure, and a lower edge has a lower mounting structure, for mounting a the top cover member thereupon. At least one vent opening is generally proximal the upper edge to allow airflow from the roof opening through the base sheet member. A plurality of first nail structures are adjacent the upper edge of the base sheet member, and a first baffle extends upwardly beside the vent opening opposite the first nail structures. A plurality of second nail structures are opposite the first baffle. A grill baffling extends laterally along the length of the top cover member adjacent the lower edge, and a second baffle extends downwardly adjacent the grill baffling and laterally the length of the top cover member.

4 Claims, 4 Drawing Sheets

ROOF EDGE INTAKE VENT

BACKGROUND OF THE INVENTION

Field of the Invention

This invention relates generally to roof vents, and more particularly to a roof edge intake vent.

Description of Related Art

Buildings, such as, for example residential buildings, are typically covered by a sloping roof. The interior portion of the building located directly below the sloping roof forms an attic. If unventilated or under-ventilated, condensation can form on the interior surfaces within the attic. The condensation can cause damage to various building components within the attic, such as, for example, insulation, as well as potentially causing damage to the building structure of the attic. In addition, unventilated or under-ventilated spaces are known to cause ice blockages ("ice dams") on the sloping roof planes. The ice blockages can cause water to damage portions of the various building components forming the roof and the attic.

Accordingly it is known to ventilate attics, thereby helping to prevent the formation of condensation. Some buildings are formed with structures and mechanisms that facilitate attic ventilation. The structures and mechanisms can operate in active or passive manners. An example of a structure configured to actively facilitate attic ventilation is an attic fan. An attic fan can be positioned at one end of the attic, typically adjacent an attic gable vent, or positioned adjacent a roof vent. The attic fan is configured to exhaust air within the attic and replace the exhausted air with fresh air.

Examples of structures configured to passively facilitate attic ventilation include ridge vents and soffit vents. Ridge vents are structures positioned at the roof ridge, which is the intersection of the uppermost sloping roof planes. In some cases, the ridge vents are designed to cooperate with the soffit vents, positioned near the gutters, to allow a flow of air to enter the soffit vents, travel through a space between adjoining roof rafters to the attic, travel through the attic and exit through the ridge vents.

An example of an existing roof edge intake vent is shown in Gassman et al., U.S. 10,370,855 (Assigned to Owens Corning). This vent includes a first portion connected to a second portion. The first portion is further connected to an upper edge and the second portion further connected to a lower edge. Opposing first and second side walls are connected to the first and second portions. The opposing first and second side walls extend from the upper edge to the lower edge. The first and second side walls form an extension having a lower surface. The first portion, upper edge, and the extension cooperate to form an air intake, such that air entering the roof deck intake vent enters the vent through the lower surface of the extension when the vent is installed on an edge or eave of a roof.

SUMMARY OF THE INVENTION

The present invention teaches certain benefits in construction and use which give rise to the objectives described below.

The present invention provides a roof edge intake vent has a base sheet member that rests over a roof opening and includes an upper edge having an upper mounting structure, and a lower edge has a lower mounting structure, for mounting a the top cover member thereupon. At least one vent opening is generally proximal the upper edge to allow airflow from the roof opening through the base sheet member. A plurality of first nail structures are adjacent the upper edge of the base sheet member, and a first baffle extends upwardly beside the vent opening opposite the first nail structures. A plurality of second nail structures are opposite the first baffle. A grill baffling extends laterally along the length of the top cover member adjacent the lower edge, and a second baffle extends downwardly adjacent the grill baffling and laterally the length of the top cover member.

A primary objective of the present invention is to provide a roof edge intake vent having advantages not taught by the prior art.

Another objective is to provide a roof edge intake vent adapted to allow air flow through a roof opening while excluding water.

A further objective is to provide a roof edge intake vent that is inexpensive to manufacture and easy to install.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a roof edge intake vent for providing ventilation to a structure.

Figure 1:
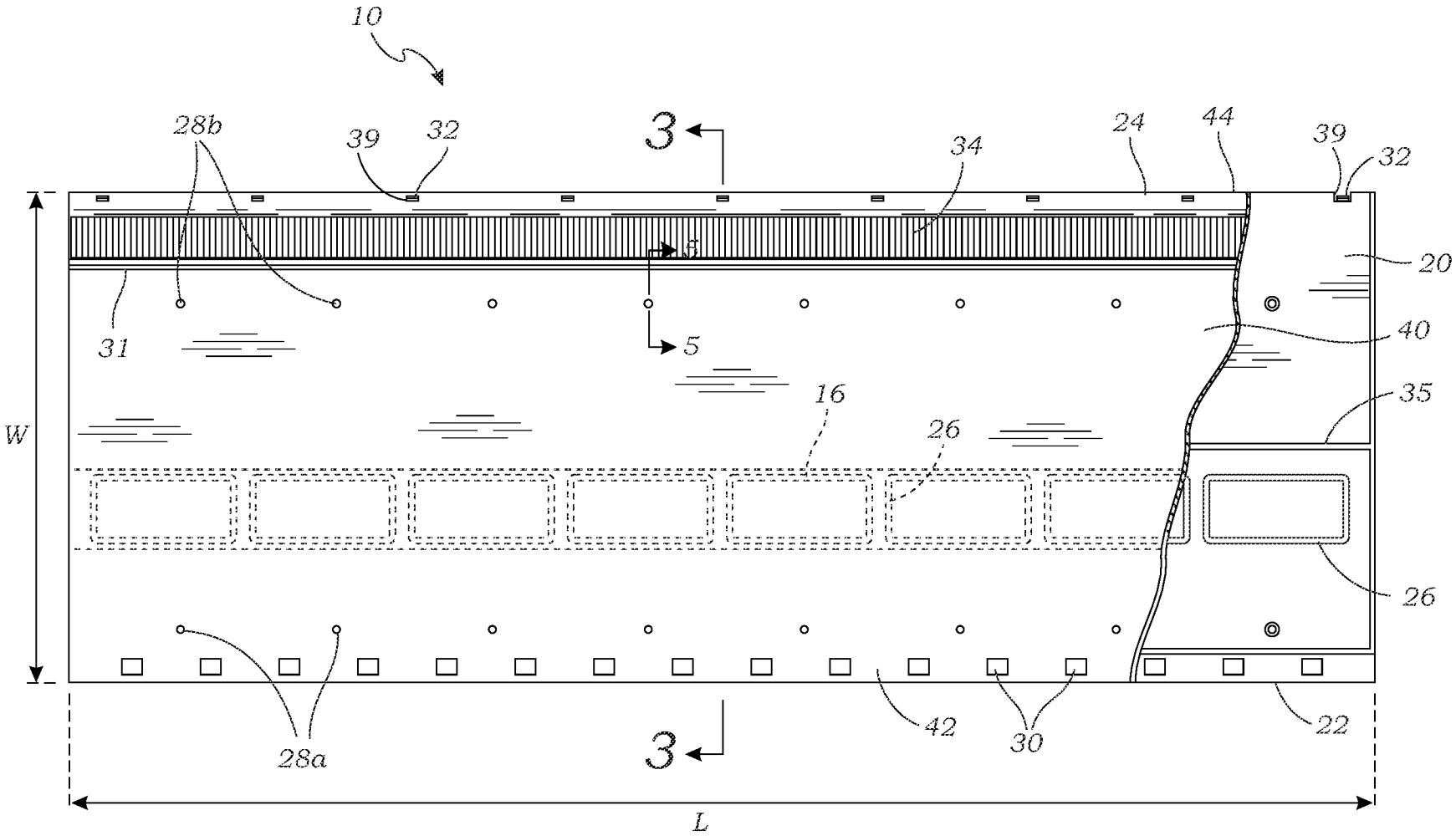
FIG. 1 is a perspective view of a roof edge intake vent according to one embodiment of the present invention, with a portion of a the top cover member shown broken away to show a base sheet member beneath.
Figure 2:
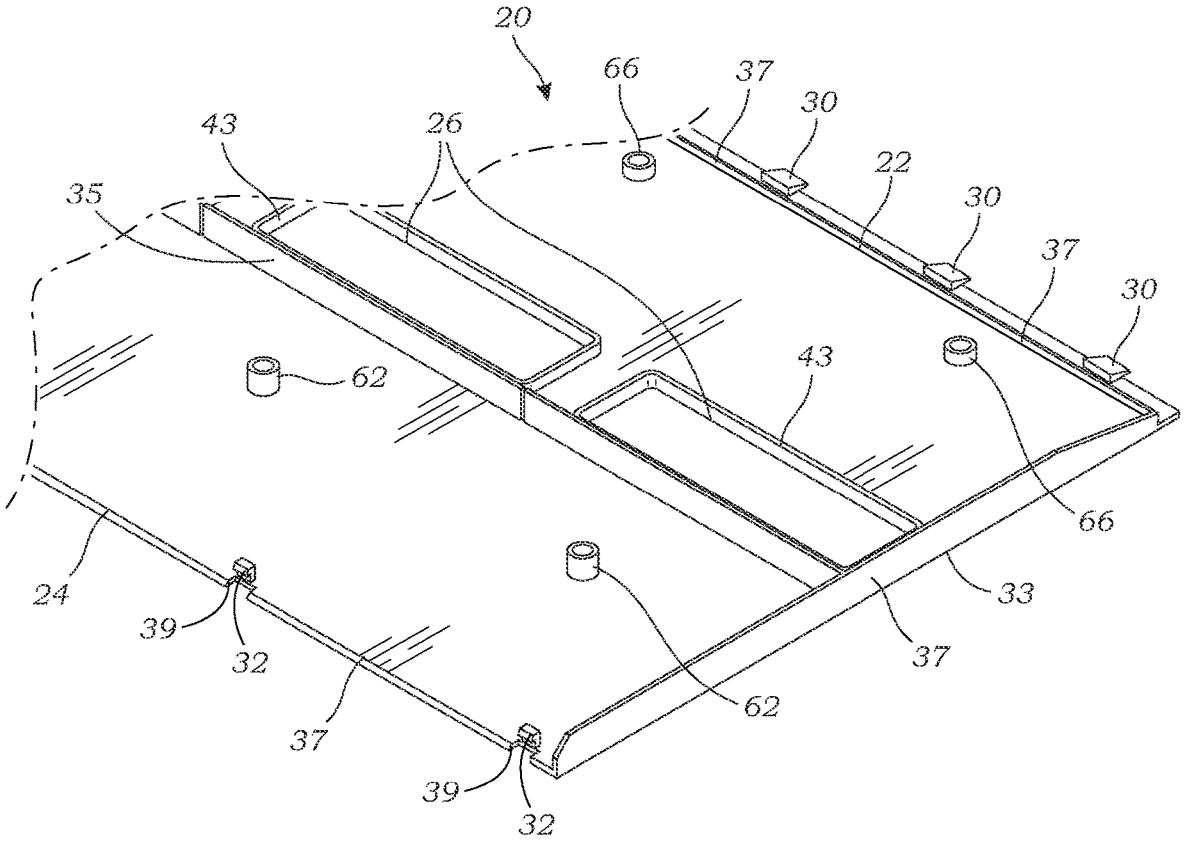
FIG. 2 is a perspective view of a portion of a base sheet member of the roof edge intake vent.

FIG. 1 is a perspective view of a roof edge intake vent 10 according to one embodiment of the present invention, with a portion of a the top cover member 40 shown broken away to show a base sheet member 20 beneath. FIG. 2 is a perspective view of a portion of the base sheet member 20 of the roof edge intake vent 10. As shown in FIGS. 1-2, the base sheet member 20 and the top cover member 40 having an upper edge 22, 42, and an opposed lower edge 24, 44, respectively. In this view, the base sheet member 20 is mostly covered by the top cover member 40, so reference to the base sheet member 20 should be made to FIG. 2.

In this embodiment, the top cover member 40 is mounted on the base sheet member 20 via upper and lower mounting structures 30 and 32, discussed at length below. The roof edge intake vent 10 has a width W and a lateral length L. In the present embodiment, the length L is between 2 ft and 6 ft, in this particular embodiment approximately 4 ft. In the present embodiment, the width W is between 8-16 includes, in this particular embodiment approximately 12 inches. However, in other embodiments, other widths and lengths may be provided, as determined by one skilled in the art.

As shown in FIGS. 1-2, at least one vent opening 26 allows airflow from the roof opening 16 through the base sheet member 20 and a grill baffling 34 that extends laterally along the length of the top cover member 40 adjacent the lower edge 44. While FIGS. 1-2 illustrate a plurality of generally rectangular vent openings 26, the at least one vent opening 26 may be any suitable shape, e.g., rounded, irregular, etc., and may be any number of vent openings (i.e., formed within a greater or lesser portion(s) of the base sheet if desired).

As shown in FIGS. 1-2, a plurality of first and second nail structures 28*a* and 28*b* are laterally spaced along the length of the roof edge intake vent 10 to enable the roof edge intake vent 10 to be nailed to the roof. The first nail structures 28*a* are positioned near the upper edges 22/42 of the intake vent 10, and the second nail structures 28*b* are positioned closer to the lower edge 24/44. Further details of the first and second nail structures 28*a* and 28*b* are illustrated in FIGS. 2-5 and discussed below. For purposes of this application, "adjacent" is defined to mean within 3 inches, "near" is defined to mean within 5 inches. "Upper" and "lower" refer to the slope of the roof, once installed.

As shown in FIGS. 1-2, the base sheet member 20 is a generally planar sheet that extends outwardly to a perimeter 33, which in this embodiment is rectangular, although other shapes and sizes may be used as desired. In this embodiment, an upwardly extending wall 37 extends upwardly around the perimeter 33 of the base sheet member 20, to prevent water from entering. In this embodiment, the upwardly extending wall includes weep holes 39 laterally spaced along the length of the lower edge 24 for allowing any accumulated moisture to escape downwardly out of the roof vent 10. As illustrated, the upwardly extending wall 37 may be different heights at the upper and lower edges 22 and 24. Furthermore, in other embodiments, the upwardly extending sidewall 37 may not be included.

As shown in FIG. 2, in this embodiment, the at least one vent opening 26 has a perimeter wall 43 that extends upwardly from the base sheet member 20 around the at least one vent opening 26, which functions to guide water away from the vent openings 26 and direct it toward the weep holes 39. In this embodiment, the plurality of first nail structures 28*a* of the base sheet are positioned adjacent the upper edge 22, between the upper edge 22 of the base sheet member 20 and the at least one vent opening 26, laterally spaced from each other along the length of the base sheet member 20 as shown in FIGS. 1-2. Furthermore, a first baffle 35 extends upwardly near the at least one vent opening 26 opposite the plurality of first nail structures 28*a*, and laterally the length of the base sheet member 20. Each of the plurality of second nail structures 28*b* of the base sheet member 20 are near the first baffle 35, opposite the at least one vent opening 26, laterally spaced from each other along the length of the base sheet member 20.

Figure 3:
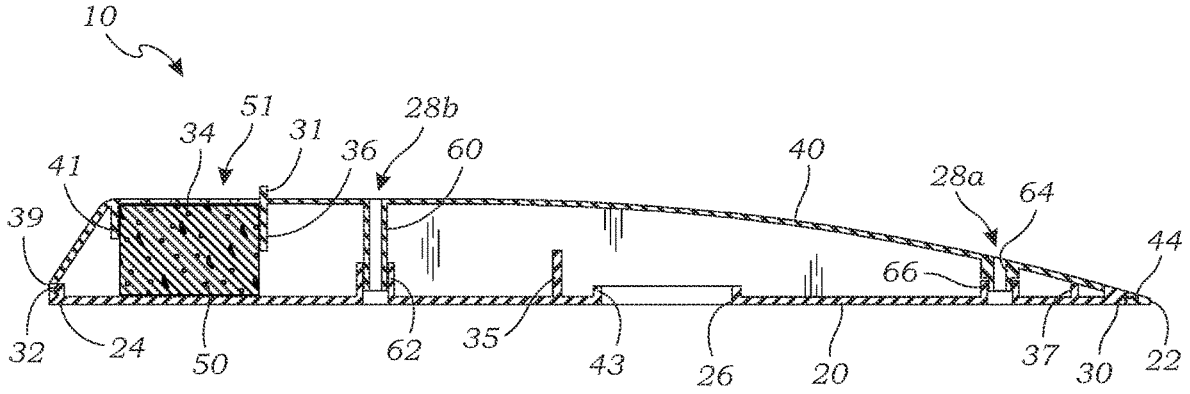
FIG. 3 is a sectional view thereof taken along line 3-3 in FIG. 1.
Figure 4:
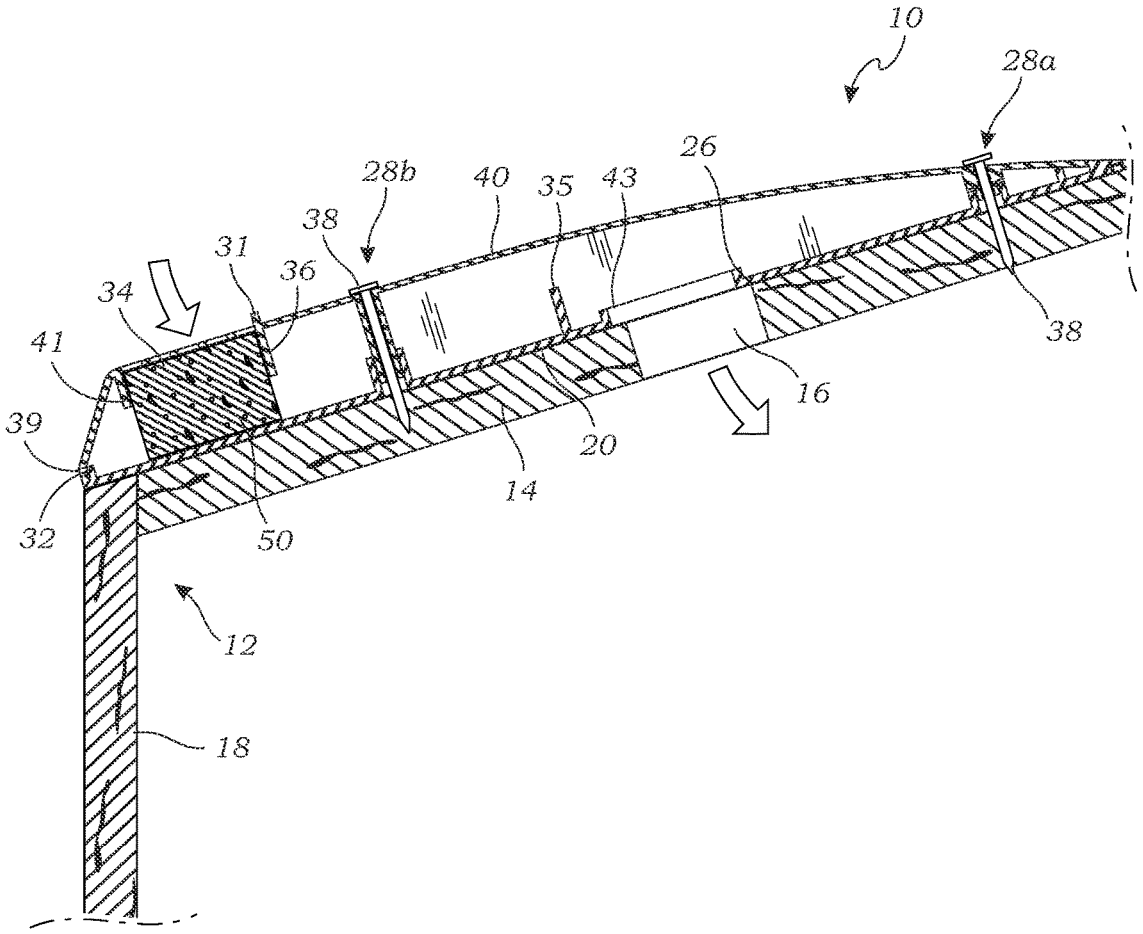
FIG. 4 is a sectional view similar to FIG. 3, illustrating the roof edge intake vent mounted on a roof of a structure.

FIG. 3 is a sectional view of the roof edge intake vent 10 taken along line 2-2 in FIG. 1. FIG. 4 is a sectional view similar to FIG. 3, illustrating an installation of the roof edge intake vent 10 on a roof decking 14 of a structure 12. As shown in FIGS. 3 and 4, the base sheet member 20 is adapted to rest on the roof decking 14 over a roof opening 16, wherein the lower edges 24 and 44 of the base sheet member 20 and the top cover member 40 are adjacent a fascia portion 16 of the roof decking 14, and the upper edges 22 and 42 are on a higher portion of the slope of the roof decking 14 than the opposed lower edges 24 and 44.

As shown in FIGS. 3-4, the roof edge intake vent 10 has the upper mounting structure 30 adjacent the upper edge 22 of the base sheet member 20, and the lower mounting structure 32 adjacent the lower edge 24 of the base sheet member 20, wherein the upper edge 42 of the top cover member 40 is engaged with the upper mounting structure 30 of the base sheet member 20, and the lower edge 44 is engaged with the lower mounting structure 32, so that the top cover member 40 is mounted onto the base sheet member 20 to cover the vent opening 26 of the base sheet member 20. In this embodiment, the upper mounting structure 30 is in the form of a hook clip positioned outside the upwardly extending wall 37 of the base sheet member 20, and the lower mounting structure 32 is in the form of a male and female clip of the base sheet member 20 and the top cover member 40, respectively. In this embodiment, each of the clips 32 is shaped to form the weep holes 39 of the base sheet member 20. In alternative embodiments, the upper and lower mounting structures 30 and 32 may each be a different form of attachment mechanism known in the art; or alternatively, the top cover member 40 may be hingeably attached to the base sheet member 20 using any form of hinge known in the art. In alternative implementations, the lower and/or upper mounting structures 30/32 may have a different form of removable or permanent attachment, e.g., frictional engagement, a latch, an adhesive, via pins, etc., or any other suitable mounting structures known in the art.

In this embodiment, each of the plurality of first nail structures 28*a* include a tubular post 64 of the top cover member 40 and a tubular post 66 of the base sheet member 20. In this embodiment, each of the plurality of second nail structures 28*b* includes a tubular post 60 of the top cover member 40 and a tubular post 62 of the base sheet member 20. In this embodiment, the tubular posts 60, 62, 64, and 66 are in the form of cylindrical posts that frictionally and coaxially engage each other, though any cross-sectional shape may be used (e.g., rectangular, etc.). Alternatively, the nail structures 28*a* and 28*b* may include other interlocking mechanisms known in the art suitable for receiving the nails 38 through the roof edge intake vent 10. The nail structures 28*a* and 28*b* in combination with the upper and lower mounting structures 30 and 32 respectively connect together, removably or permanently, to form the fully constructed roof vent 10. As illustrated, the plurality of first and second nail structures 28*a* and 28*b* are adapted to receive nails 38 therethrough, wherein the nails are driven into the roof decking for 14 for securing the roof vent 10 onto the structure 14.

As shown in FIGS. 3-4, the grill baffling 34 extends laterally along the length of the top cover member 40 adjacent the lower edge 42 for allowing airflow therethrough, and a second baffle 36 extends downwardly between the grill baffling 34 and the plurality of second nail structures 28*b*, and laterally the length of the top cover member 40. Furthermore, a third baffle 41 extends downwardly between the lower edge 44 and the grill baffling 34, wherein the second and third baffles 36 and 41 together form a filter receiving structure 51 for receiving a filter 50. The filter 50 may be any suitable filter known in the art for excluding debris, bugs, and such from passing through the vent 10. However, in other embodiments, the filter 50 may not be included. In various embodiments, each of the first, second, and third baffles 35, 36, and 41 may be shorter or taller in heights than is shown in the figures, as desirable for optimal air flow, which should be considered within the scope of the present invention.

As shown in FIGS. 3-4, in some embodiments, the top cover member 40 may further include a shingle stop 31 extending upwardly (opposite the second baffle 36) adjacent the grill baffling 34 opposite the lower edge 44, adapted to assist with positioning of roof shingles (not shown) following installation of the roof intake vent 10. In alternative embodiments, the shingle stop 31 may be excluded from the structure.

Figure 5:
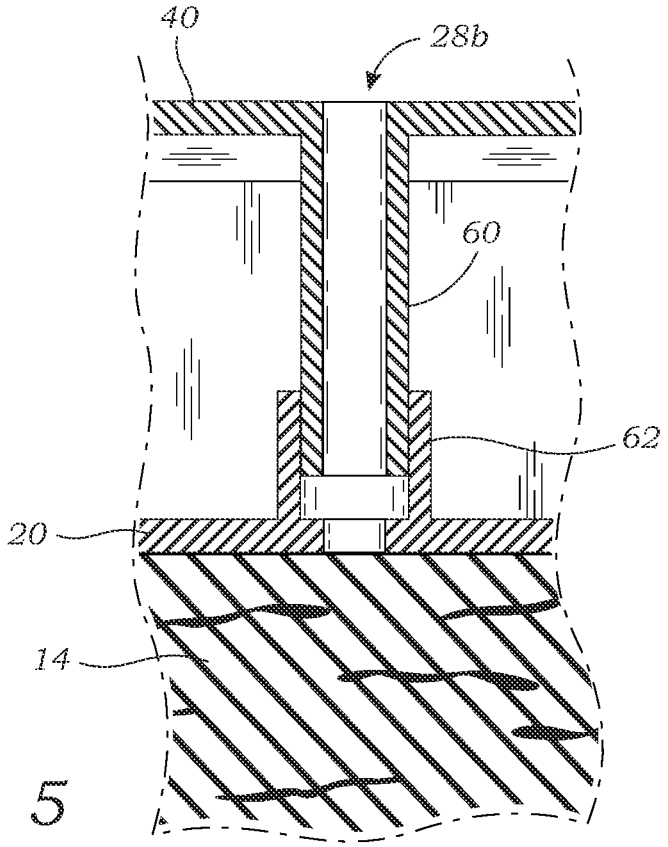
FIG. 5 is a sectional view taken along lines 5-5 in FIG. 1, illustrating a close up view of a nail receiving structure.
Figure 6:
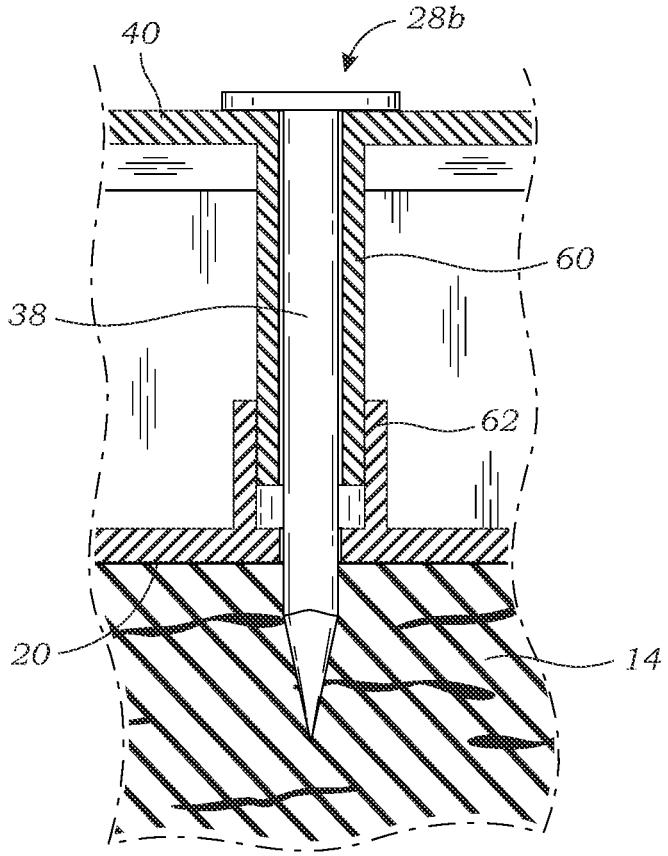
FIG. 6 is a close up view similar to FIG. 4, illustrating a nail through the nail receiving structure and into the roof of the structure.

FIG. 5 is a close-up view of one of the nail receiving structures 28*b*. FIG. 6 is a close up view similar to FIG. 5, illustrating a nail 38 through the nail receiving structure 28*b*, and into the roof decking 14 of the structure 12. As shown in FIGS. 5 and 6 and discussed above, in this embodiment, the nail receiving structures 28*b* is formed of tubular posts 60 and 62. The receiving structure 28 a is similarly formed, as discussed above.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A roof edge intake vent for installation on a roof decking, secured with nails, for providing ventilation through a roof opening of the roof decking, the roof edge intake vent comprising:

a base sheet member adapted to rest on the roof decking over the roof opening, the base sheet member having an upper edge and an opposed lower edge;

an upper mounting structure adjacent the upper edge of the base sheet member;

a lower mounting structure adjacent the lower edge of the base sheet member;

a plurality of first nail structures near the upper edge of the base sheet member, laterally spaced from each other along the length of the base sheet member;

at least one vent opening adjacent the plurality of first nail structures, opposite the upper edge, for allowing airflow from the roof opening through the base sheet member;

a first baffle extending upwardly from the base sheet member adjacent the at least one vent opening opposite the plurality of first nail structures, and extending laterally a length of the base sheet member;

a plurality of second nail structures adjacent the first baffle, opposite the at least one vent opening, and laterally spaced from each other along the length of the base sheet member;

a top cover member adapted to cover the base sheet member, the top cover member having an upper edge and an opposed lower edge, the upper edge of the top cover member being engaged with the upper mounting structure of the base sheet member, and the lower edge being engaged with the lower mounting structure of the base sheet member, so that the top cover member covers the vent opening of the base sheet member;

a grill baffling extending laterally along the length of the top cover member adjacent the lower edge for allowing airflow therethrough;

a second baffle extending downwardly from the top cover member between the second nail structures and the grill baffling, extending laterally the length of the top cover member;

a third baffle extending downwardly from the top cover member between the lower edge of the top cover member, and the grill baffling; and wherein the second and third baffles, and the grill baffling, together form a filter receiving structure for receiving a filter.

2. The roof intake vent of claim 1, wherein the at least one vent opening has a perimeter edge that extends upwardly from the base sheet member around the at least one vent opening.

3. The roof intake vent of claim 1, further comprising an upwardly extending wall extending upwardly around a perimeter of the base sheet member, wherein the upwardly extending wall includes weep holes laterally spaced along the length of the lower edge.

4. A roof edge intake vent for installation on a roof decking for providing ventilation through a roof opening of the roof decking, the roof edge intake vent comprising:

a base sheet member adapted to rest on the roof decking over the roof opening, the base sheet member having an upper edge and an opposed lower edge, and two side edges, forming a perimeter;

an upwardly extending wall extending upwardly around a perimeter of the base sheet member, wherein the upwardly extending wall includes weep holes laterally spaced along the length of the lower edge;

an upper mounting structure at the upper edge of the base sheet member;

a lower mounting structure at the lower edge of the base sheet member;

a plurality of first nail structures near the upper edge of the base sheet member, laterally spaced from each other along the length of the base sheet member;

at least one vent opening adjacent the plurality of first nail structures, opposite the upper edge;

a first baffle extending upwardly from the base sheet member near the vent opening opposite the plurality of first nail structures, and extending laterally a length of the base sheet member;

a plurality of second nail structures near the first baffle opposite the at least one vent opening, and laterally spaced from each other along the length of the base sheet member;

a top cover member adapted to cover the base sheet member, the top cover member having an upper edge and an opposed lower edge, the upper edge of the top cover member being engaged with the upper mounting structure of the base sheet member, and the lower edge being engaged with the lower mounting structure of the base sheet member, so that the top cover member covers the vent opening of the base sheet member;

a grill baffling extending laterally along the length of the top cover member adjacent the lower edge for allowing airflow therethrough;

a second baffle extending downwardly from the top cover member between the second nail structures and the grill baffling, extending laterally the length of the top cover member;

a third baffle extending downwardly from the top cover member between the lower edge of the top cover member, and the grill baffling; and wherein the second and third baffles, and the grill baffling, together form a filter receiving structure for receiving a filter.

* * * * *